United States Patent [19]

Kegler et al.

[11] 4,235,703

[45] Nov. 25, 1980

[54] METHOD FOR PRODUCING PREMIUM COKE FROM RESIDUAL OIL

[75] Inventors: William H. Kegler; James R. McConaghy, both of Ponca City, Okla.

[73] Assignee: Conoco, Inc., Ponca City, Okla.

[21] Appl. No.: 24,345

[22] Filed: Mar. 27, 1979

[51] Int. Cl.[3] ..... C10G 9/14; C10G 55/04

[52] U.S. Cl. ..... 208/89; 208/131

[58] Field of Search ..... 208/89, 131, 251 R, 208/251 H

[56] References Cited

U.S. PATENT DOCUMENTS

| | | | |
|---|---|---|---|
| 3,773,653 | 11/1973 | Nongbri et al. | 208/89 |
| 3,795,607 | 3/1974 | Adams et al. | 208/251 H |
| 3,825,488 | 7/1974 | Gatsis | 208/251 H |
| 3,876,523 | 4/1975 | Rosinski et al. | 208/89 |
| 4,052,295 | 10/1977 | Pronk | 208/251 H |
| 4,102,779 | 7/1978 | Hensley, Jr. | 208/251 H |

*Primary Examiner*—Herbert Levine

*Attorney, Agent, or Firm*—Richard W. Collins

[57] ABSTRACT

A petroleum refinery residual oil derived from a naphthenic crude oil is catalytically demetalized, catalytically desulfurized and then fed to a delayed coker to produce premium delayed coke.

6 Claims, 1 Drawing Figure

METHOD FOR PRODUCING PREMIUM COKE FROM RESIDUAL OIL

BACKGROUND OF THE INVENTION

1. Field of the Invention

This invention relates to delayed coking of a petroleum residuum, and more particularly to the production of premium delayed coke, suitable for formation of graphite electrodes for use in electric arc steel furnaces.

Delayed coking of residuum (residual oil) from a petroleum refinery vacuum distillation unit generally produces a coke having a longitudinal coefficient of thermal expansion (CTE) of about $20\times10^{-7}$/°C. or greater after graphitization. The CTE of a graphitized coke is an important measure of its suitability for use in the manufacture of electrodes for electric arc steel furnaces. For example, the manufacture of 61 cm diameter electrodes requires a coke having, among other specified characteristics, a CTE of about $5\times10^{-7}$/°C. or less, and the manufacture of 38 cm diameter electrodes requires a coke having a CTE of no more than about $8.0\times10^{-7}$/°C.

Delayed premium coke is different in many respects from regular delayed coke, and is generally manufactured from specific feedstocks such as decant oil from a liquid catalytic cracker, tar from thermal cracking of regular coker gas oil, pyrolysis tars, or blends of these materials, sometimes with a minor amount of residual oil included in the feedstock. Vacuum residual oil has, prior to this invention, always been considered in the industry as a material incapable of making premium coke when used as the principal ingredient of a delayed coker feedstock, even when coked at conditions which produce premium coke from conventional premium coke feedstocks.

Premium delayed coke, as mentioned above, is a different material from regular delayed coke, which is generally used only as a fuel. Some better quality regular delayed cokes are suitable for use as anodes in aluminum smelting processes, and such cokes are sometimes referred to as metallurgical grade delayed cokes. However, even these better grade metallurgical delayed cokes are a different type of material than what is recognized by and referred to in the industry as premium delayed coke.

Premium coke is worth several times as much as regular coke, and yet the operating costs of a premium delayed coker, not considering the cost of the feedstock, are not greatly different from the costs for a regular coker. Accordingly, any process by which a low value material such as residual oil could be utilized as a premium coker feedstock is much to be desired.

2. The Prior Art

Delayed coking is a routine petroleum refining step used in most cases to dispose of low value residual oils and to convert such residual oils into more valuable products. The operating conditions and process steps of the delayed coking process, both for regular coke and premium coke, are well established and widely known.

The broad process of hydrotreating a residual oil followed by delayed coking of the hydrotreated stream is described in U.S. Pat. Nos. 2,871,182; 2,963,416; and 3,684,688. In addition, U.S. Pat. No. 3,773,653 describes a process of desulfurizing demetalizing residual oil using an ebullated bed reaction zone prior to delayed coking of the hydrotreated stream. More recently, processes including hydrotreating vacuum residuum followed by coking of the hydrotreated stream are described in U.S. Pat. Nos. 3,891,538 and 3,902,991.

Several of the above-mentioned references point out that the coke product obtained has a reduced sulfur and metals content due to the hydrotreating step. Further, several of these references suggest that the coke product is of an improved quality due to the pretreatment of the coker feedstock. However, none of the above-mentioned patents suggests that a premium coke can be obtained by demetalizing and desulfurizing a high sulfur and high metals vacuum residuum and coking the treated residuum in a delayed coker at premium coking conditions. The best coke that can be obtained from residual oil feedstocks, according to the prior art patents, is a coke suitable for use as anodes in the aluminum industry. None of these patents suggests that a premium coke suitable for use in making graphite electrodes for electric arc steel furnaces can be obtained by a process including demetalizing and desulfurizing vacuum residuum followed by delayed coking of the treated residuum.

It is accordingly quite unexpected that a vacuum residuum having high sulfur and high metals content could produce a premium coke. Because of the wide difference in value between regular or metallurgical grade delayed coke and premium delayed coke, it is clearly desirable to be able to produce premium coke from vacuum residuum, and the present invention provides this capability.

SUMMARY OF THE INVENTION

According to the present invention, a high sulfur and high metals content petroleum refinery vacuum residuum stream derived from a naphthenic crude oil is catalytically demetalized, then catalytically desulfurized, and then subjected to delayed coking under premium coking conditions to produce a premium coke suitable for manufacture of graphite electrodes.

DESCRIPTION OF THE DRAWING

The drawing is a schematic flowsheet illustrating the process of the invention.

DESCRIPTION OF THE PREFERRED EMBODIMENT

Figure 1:
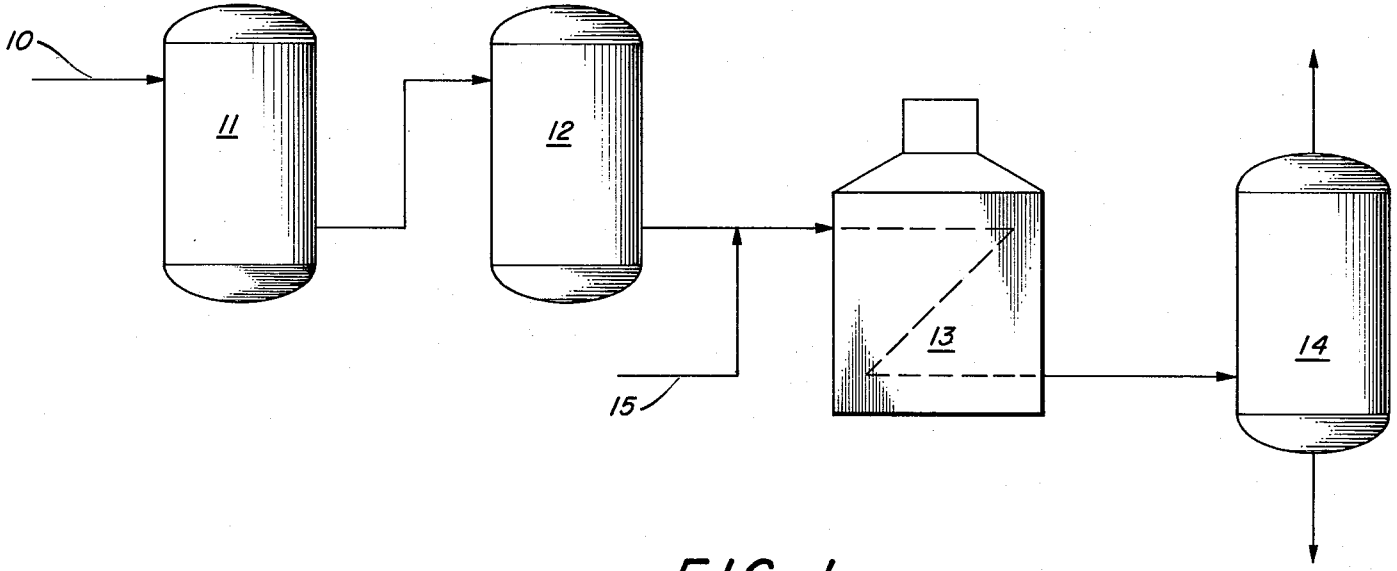

Feedstocks for which the invention is applicable are residual oils derived from distillation of naphthenic crude oils having a UOP Characterization Factor (K factor) of 11.4 or lower. The K factor is defined as the cube root of the average boiling point in degrees Rankine divided by the specific gravity at 60° F. Such residual oils have the particular molecular structure to produce premium coke when processed according to the invention. The feedstocks also must have a 5 percent boiling point between 470° and 580° C. when subjected to ASTM Distillation Test D-1160. The invention is particularly applicable to feedstocks which have the above-noted essential characteristics and additionally have a metals content, defined as total vanadium and nickel, of at least 25 parts per million by weight, and a sulfur content of more than 2 percent by weight.

The first step in the process of the invention involves subjecting an appropriate residual oil as defined above to a catalytic demetalation step, preferably over a vanadium promoted alumina catalyst, at rather severe conditions including a temperature of at least 400° C., a pressre of at least 75 kg/cm$^2$, a liquid hourly space velocity of less than 0.25 and a hydrogen rate of 500 to 1000 standard cubic meters per cubic meter of residual oil. The demetalation step protects the desulfurization catalyst from premature deactivation by reducing the amount of potentially damaging vanadium and nickel, and further serves to convert asphaltenes in the feedstock to components suitable for formation of premium delayed coke.

The demetalized residual oil is then subjected to catalytic desulfurization over a desulfurization catalyst, preferably a cobalt-molybdenum catalyst, at a temperature of at least 370° C., a pressure of at least 50 kg/cm$^2$, a liquid hourly space velocity of from 0.2 to 1.0 and a hydrogen rate of from 500 to 1000 standard cubic meters per cubic meter of residual oil.

The demetalized and desulfurized residual oil is then subjected to delayed coking at premium coking conditions including a coker furnace outlet temperature of from 425° to 540° C., coke drum vapor outlet temperature of from 400° to 520° C. and coke drum pressure of from 0.5 to 7 kg/cm$^2$.

The process is illustrated in the drawing where a suitable residual oil is fed from line 10 to demetalizer 11, then to desulfurizer 12, then to coker furnace 13 and finally to coke drum 14. In some cases, conventional premium coker feedstock may be blended with the demetalized and desulfurized residual oil through line 15. Also, recycle gas oil from the coker fractionator (not shown) may be introduced in an amount of from 0.5 to 1.5 times the residual oil volume into line 15 to optimize the coking operation. In some cases, hydrotreating of the recycle gas oil will further improve the quality of the premium coke product.

The process is particularly useful for making premium coke from vacuum residual oil derived from a naphthenic crude such as Arabian Heavy having a K factor of less than 11.4, a sulfur content of more than 4.0 percent by weight and a metals content of more than 100 parts per million.

The results obtainable from the process of the invention are set forth in the following example.

EXAMPLE I

In this example, an Arabian Heavy residual oil having a sulfur content of 4.9 percent by weight and a vanadium and nickel content of 120 and 56 parts per million by weight respectively was coked in a pilot plant coker using a coke drum overhead vapor temperature of 510° C. and a coke drum pressure of 1.75 kg/cm$^2$. The resulting green coke had a sulfur content of 6.9 percent by weight and a vanadium and nickel content of 510 and 277 parts per million by weight respectively. Graphitized electrodes prepared from the green coke had an average coefficient of thermal expansion of $18.5\times10^{-7}$/° C.

The same feedstock was then subjected to demetalation over a vanadium promoted alumina catalyst at a temperature of 425° C., a pressure of 126 kg/cm$^2$, a liquid hourly space velocity of 0.1 and a hydrogen rate of 900 standard cubic meters per cubic meter of residual oil, followed by desulfurization over a cobalt-molybdenum catalyst at a temperature of 370° C., a pressure of 84 kg/cm$^2$, a liquid hourly space velocity of 0.5 and a hydrogen rate of 900 standard cubic meters per cubic meter of residual oil. The demetalized and desulfurized residual oil was then coked at the same conditions as the untreated residual oil described above. The resulting green coke had a sulfur content of 2.4 percent by weight and a vanadium and nickel content of 79 and 73 parts per million by weight respectively. Graphitized electrodes prepared from this coke had an average coefficient of thermal expansion of $5.1\times10^{-7}$/°C.

The foregoing example illustrates that a premium type coke, suitable for making graphitized electrodes having a low coefficient of thermal expansion, can be made from a high sulfur and high metals residual oil by the process of this invention.

We claim:

1. A method of making premium delayed petroleum coke comprising:

(a) subjecting a petroleum residual oil having a 5 percent boiling point between 470° and 580° C. and being derived from distillation of a naphthenic crude oil having a K factor of 11.4 or lower to a catalytic demetalation step at a temperature of at least 400° C., a pressure of at least 75 kg/cm$^2$ and a liquid hourly space velocity of less than 0.25;

(b) subjecting the demetalized residual oil to catalytic desulfurization at a temperature of at least 370° C. and a pressure of at least 50 kg/cm$^2$ and a liquid hourly space velocity of from 0.2 to 1.0;

(c) subjecting the demetalized and desulfurized residual oil to delayed coking under premium coking conditions; and (d) recovering premium delayed coke capable of producing graphite electrodes having a longitudinal coefficient of thermal expansion of less than $8.0\times10^{-7}$/°C.

2. The method of claim 1 wherein the demetalation takes place in the presence of a vanadium promoted alumina catalyst.

3. The method of claim 1 wherein the desulfurization takes place in the presence of a cobalt-molybdenum desulfurization catalyst.

4. The method of claim 1 wherein the residual oil contains more than 2 percent by weight sulfur and more than 25 parts per million combined vanadium and nickel.

5. The method of claim 1 wherein the residual oil is derived from Arabian Heavy crude oil and contains more than 4.0 percent by weight sulfur and more than 100 parts per million combined vanadium and nickel.

6. The process of claim 1 wherein coker gas oil recycle in an amount of from 0.5 to 1.5 times the volume of residual oil feedstock is added thereto prior to introducing the feedstock to the coker furnace.

* * * * *